US005377630A

United States Patent [19]

Schlunke et al.

[11] Patent Number: 5,377,630

[45] Date of Patent: Jan. 3, 1995

[54] MULTICYLINDER TWO-STROKE ENGINE INTAKE MANIFOLD

[75] Inventors: Christopher K. Schlunke, South City Beach; Kenneth P. Seeber, Wanneroo; Rodney A. R. Houston, Kingsley; Christopher N. F. Sayer, Ferndale, all of Australia

[73] Assignee: Orbital Engine Company (Australia) Pty. Limited, Balcatta, Australia

[21] Appl. No.: 107,831

[22] PCT Filed: Mar. 20, 1992

[86] PCT No.: PCT/AU92/00119

§ 371 Date: Aug. 30, 1993

§ 102(e) Date: Aug. 30, 1993

[87] PCT Pub. No.: WO92/16726

PCT Pub. Date: Oct. 1, 1992

[30] Foreign Application Priority Data

Mar. 22, 1991 [AU] Australia ..... PK 5250

[51] Int. Cl.[6] ..... F02B 75/18

[52] U.S. Cl. ..... 123/184.22; 123/73 R

[58] Field of Search ..... 123/52 M, 52 MC, 73 R, 123/195 P, 735, 542; 60/599

[56] References Cited

U.S. PATENT DOCUMENTS 3,060,914 10/1962 Morand ..... 123/52 M

FOREIGN PATENT DOCUMENTS

12144/88 8/1988 Australia .

2234780A 2/1991 United Kingdom .

*Primary Examiner*—Noah P. Kamen

*Attorney, Agent, or Firm*—Nikaido, Marmelstein, Murray & Oram

[57] ABSTRACT

A multicylinder two-stroke cycle internal combustion engine (10) comprises an individual crankcase cavity (18) for each cylinder to receive the incoming air charge for that cylinder and a cylinder block (11) with at least two cylinders having cooperating crankcase cavities (18) provided with valve controlled intake ports (19) in a common wall (31) of the cylinder block (11). An air induction manifold (25) is detachably mounted to the common wall (31) to form a single air induction cavity (27), at least part of which is formed within the cylinder block (11), and has a single main inlet port for regulation of air inflow to the induction cavity (27). Individual passages (33) communicating each crankcase cavity inlet port (19) with the air induction cavity (27) are formed in the manifold (25). Acceptable performance with limited increase in the overall physical dimensions of the engine (10) can thus be obtained.

7 Claims, 4 Drawing Sheets

MULTICYLINDER TWO-STROKE ENGINE INTAKE MANIFOLD

This invention relates to the construction of the induction manifold through which the incoming air is distributed to the respective crankcase cavities of a multi-cylinder crankcase compression two stroke cycle engine.

BACKGROUND OF THE INVENTION

In many multi cylinder two stroke cycle engines, individual carburetors are provided to regulate the fuel and air supply to the respective crankcase cavities from which the fuel and air is supplied to the respective cylinders of the engine. In fuel injected engines it is customary to provide an air induction manifold having a single air inlet, with each crankcase cavity of the engine communicating directly with the interior of the manifold through a respective one-way valve.

In a two stroke cycle multi-cylinder engine it is known that from the point of view of performance considerations, where the intake of air to the cylinders is provided from a common manifold, the common manifold should have a capacity at least equal to the total swept volume of the engine, and preferably 1.2 to 1.5 times the total swept volume of the engine. The provision of a manifold of this capacity currently substantially increases the overall physical dimensions of the engine assembly together with increases in weight and material costs.

SUMMARY OF THE INVENTION

It is therefore the object of the present invention to provide a two stroke cycle multi-cylinder engine having an air intake manifold construction that has an air capacity appropriate for acceptable performance with limited increase in the overall physical dimensions of the engine.

With this object in view, there is provided a multi-cylinder two stroke cycle internal combustion engine comprising a cylinder block having at least two cylinders therein, an individual crankcase cavity for each cylinder to receive the incoming air charge for the respective cylinder, said crankcase cavities each having respective valve controlled intake ports in a common wall of the cylinder block, an air induction manifold detachably mounted to said common wall of the cylinder block to form therewith a single air induction cavity communicating with each crankcase cavity inlet port, at least part of said air induction cavity being formed within the cylinder block, and at least one inlet port in said manifold for the entry of air to said induction cavity.

Preferably individual passages are formed within the induction manifold to provide the communication between air induction cavity and the respective intake ports.

Conveniently, the cylinder block has a planar face with a first opening therein communicating with an internal cavity within the confines of the block, that cavity being closed apart from said first opening, and respective second openings therein forming, or communicating with, said air intake ports to the respective crankcase cavities. The manifold may also have a planar face complementary to the cylinder block planar face, and complementary first and second openings therein so that with said respective planar faces in abutting relation the two first openings and the respective second openings in the cylinder block and manifold are in registration with one another.

The incorporation of part of the required air capacity of the induction manifold within the cylinder block reduces the overall dimension of the engine assembly in width and/or height across the induction manifold without a sacrifice in the capacity of the air induction cavity and a consequent detraction in engine performance. There is also a resultant saving in material and weight.

The present invention is also applicable to engines operating on cycles other than the two stroke cycle, such as on the four stroke cycle, and thus the invention includes a multi cylinder internal combustion engine comprising a cylinder block having at least two cylinders therein, an air induction manifold mounted on said block to define therewith a single air induction cavity with at least part thereof formed within the confines of the cylinder block, at least one inlet port in said manifold for the entry of air to said cavity, and a respective passage to communicate said cavity independently with each cylinder of the engine.

BRIEF DESCRIPTION OF THE DRAWINGS

The invention will be more readily understood from the following description of one practical arrangement of the engine as illustrated in the accompanying drawings.

In the drawings.

DESCRIPTION OF THE PREFERRED EMBODIMENTS

Figure 1:
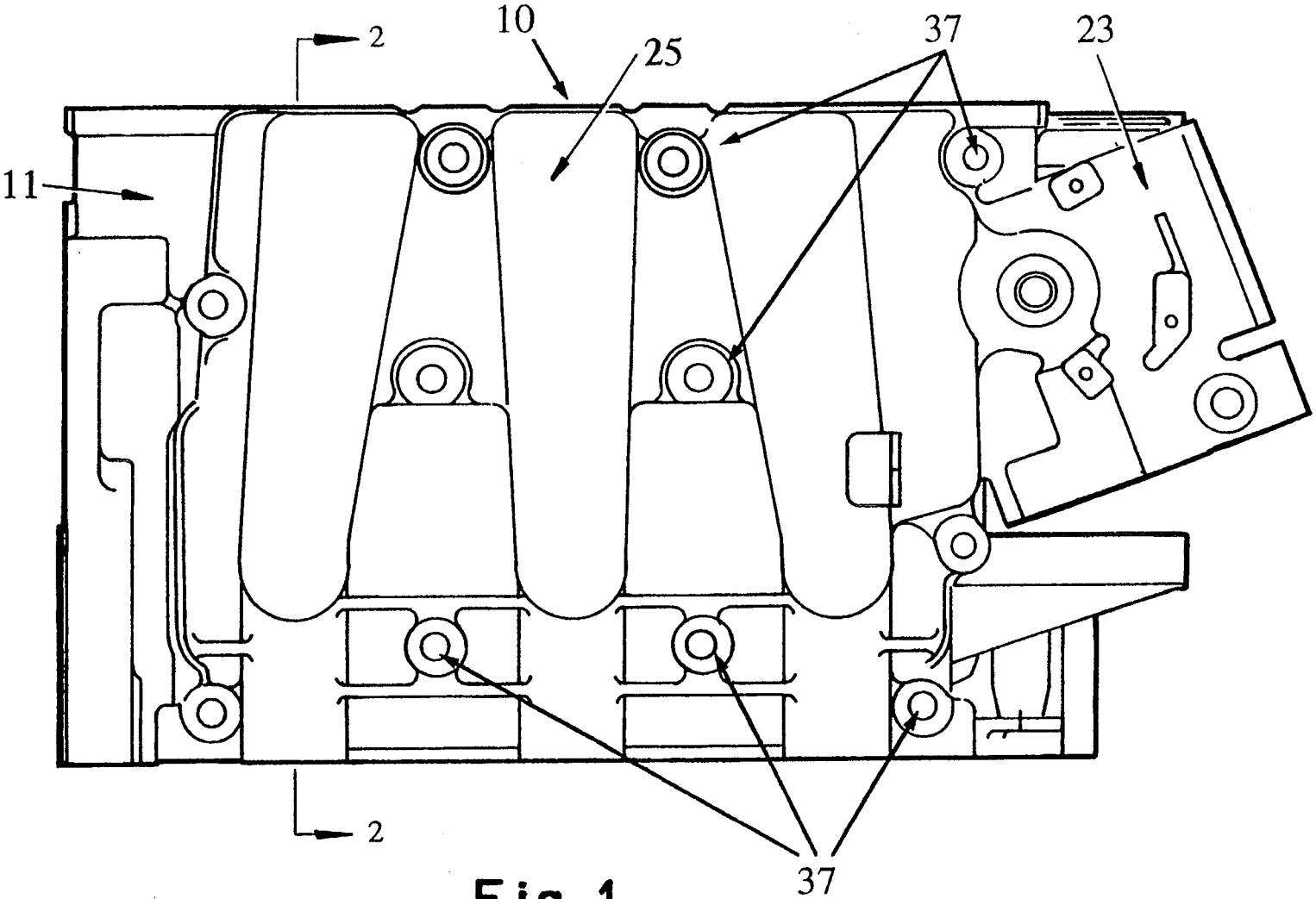
FIG. 1 is a side view of an engine with the induction manifold fitted thereto.
Figure 2:
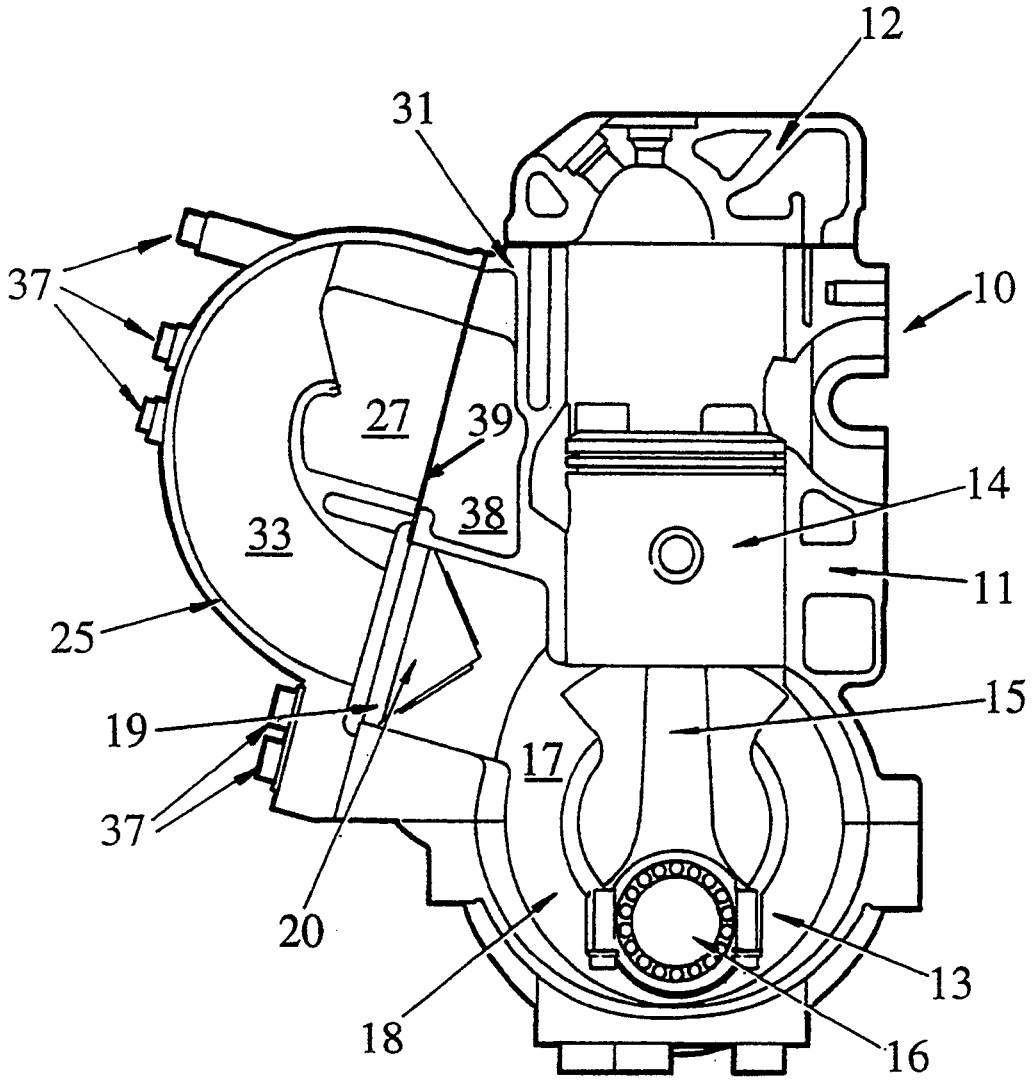
FIG. 2 is a sectional view along line 2—2 in FIG. 1 with the addition of the cylinder head and crankcase.
Figure 3:
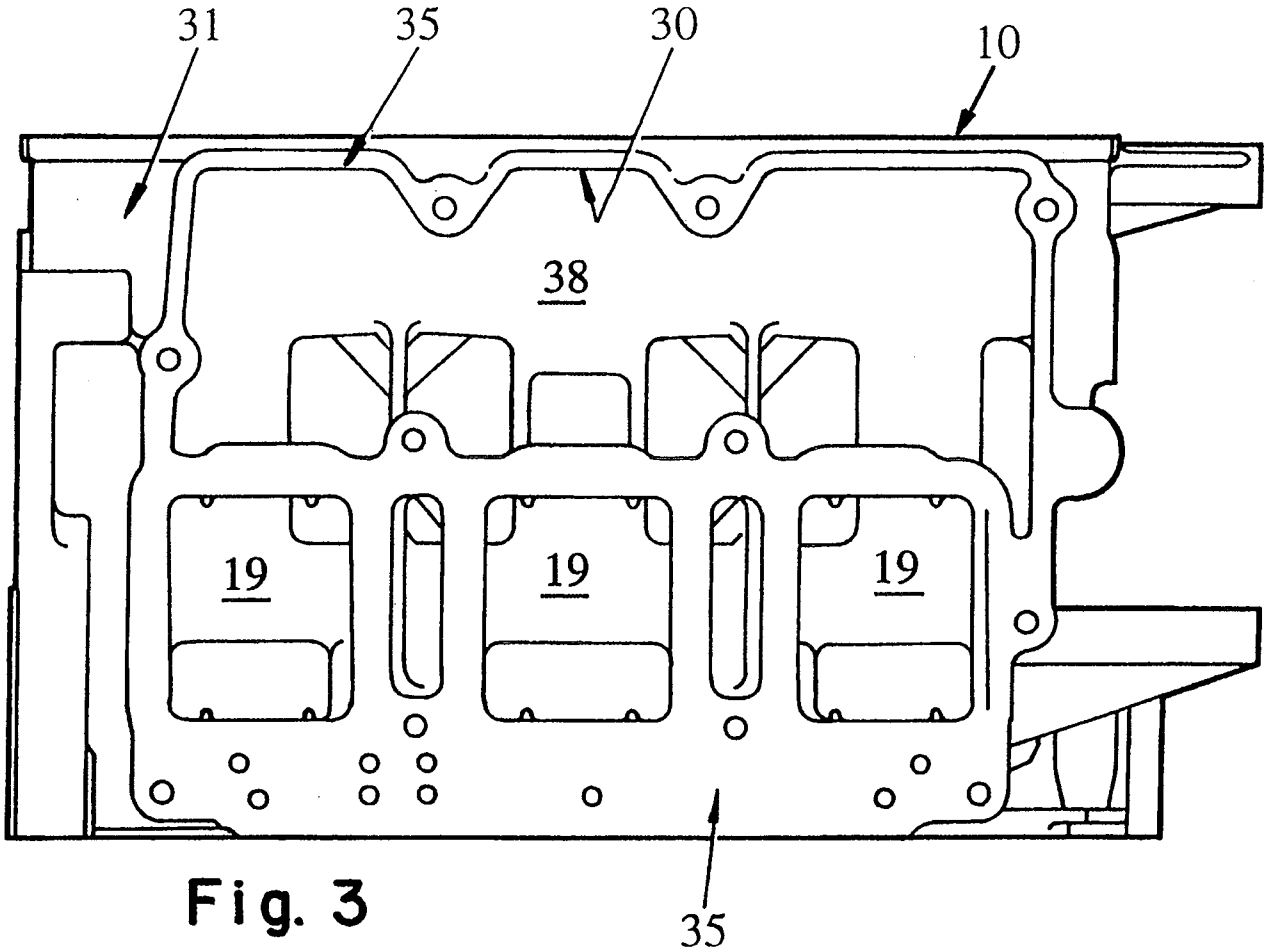
FIG. 3 is side view of the cylinder block with the induction manifold removed.

Referring now to the drawings, and particularly FIGS. 2 and 3, the engine 10 is of the generally conventional two stroke cycle construction having a cylinder block 11 with three inline cylinders, a cylinder head 12 and crankcase 13. Each piston 14 is coupled by a conventional connecting rod 15 to the crankshaft 16 with the crankcase 13 and lower portion of the cylinder block 11 forming intermediate walls 17 dividing the crankcase into respective compartments 18 for the engine to operate on the conventional crankcase compression system.

Each crankcase compartment 18 has an individual inlet port 19 in which is fitted a conventional reed valve assembly 20 that only permits a flow of air into the crankcase compartment when the pressure in the compartment is below that within the manifold 25. Each individual air inlet port 19 is in direct communication with the main induction chamber 27 of the manifold 25. A main intake passage 23 is provided at one end of the manifold communicating with the main induction chamber 27 and having a conventional throttle valve (not shown) mounted therein.

The cylinder block 11 has an opening 39 in the wall 31 thereof of a shape to complement the shape of the open side 32 of the manifold 25. The cavity 38 provided within the cylinder block, is accessible through the opening 39 in the side wall 31 of the cylinder block and is closed against access to atmosphere other than through the main induction chamber 27 and main air intake passage 23.

The common wall 31 of the cylinder block has a planar surface 35 which extends completely about the periphery of the opening 39 and about each of the crankcase compartment inlet ports 19. The manifold 25 has a complementary planar surface 36 which extends completely about the periphery of the open side 32 of the manifold and about each of the passages 33 in the manifold that communicate with the inlet ports 19 of the crankcase compartments. The manifold is sealably attached to the cylinder block by the bolts 37 preferably with a gasket therebetween.

Internal passages 33 are formed integral with the manifold 25, and located within the chamber 27. Each passage providing communication between the main induction chamber 27 and the respective inlet ports 19 in the planar face 35 of the cylinder block.

Figure 4:
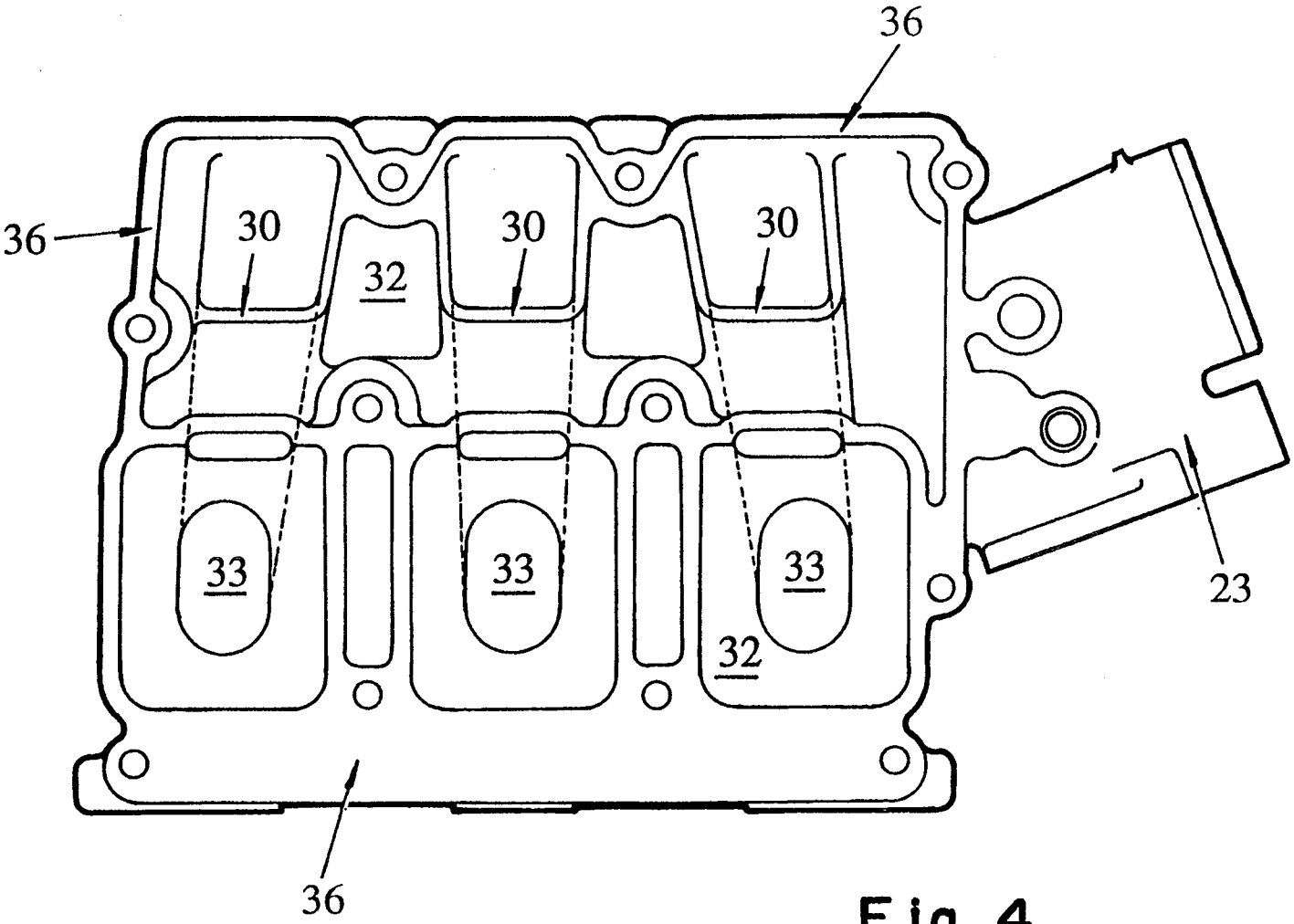
FIG. 4 is an internal view of the induction manifold removed from the engine.

The passages 33 are of a length determined to be "tuned" to the operation of the engine in a selected speed range to provide improved intake of air to the crankcase compartments. As seen in FIG. 4, a substantial portion of the length of the passages 33 is located within the confines of the manifold. This assists in minimising the overall dimensions of the engine and manifold assembly, particularly by enabling the manifold to be located closer to the cylinder block and the inlet ports to the respective crankcase compartments while still being of the required tuned length.

This arrangement of the passages 33 within and as part of the manifold permits simple alteration of the actual length of the passages by merely varying the height of the upper edge 30 of the respective passages 33. Thus the same basic manifold casting can be used to meet a range of tuned length inlet of the inlet passages 33, with the heights of the manifold with respect to the engine block unchanged. Further the height of the manifold can be reduced to a level not higher than the cylinder head. Further, as part of the required internal volume of the induction chamber 27 is provided within the cylinder block, a reduction in overall width of the cylinder block-induction manifold assembly is achieved without reduction in the required internal volume.

We claim:

1. A multi-cylinder two stroke cycle internal combustion engine comprising a cylinder block having at least two cylinders therein, an individual crankcase cavity for each cylinder to receive the incoming air charge for the respective cylinder, each said crankcase cavity having a respective valve controlled inlet port in a common wall of the cylinder block, an air induction manifold detachably mounted to said common wall of the cylinder block to form therewith a single air induction cavity communicating with each crankcase cavity inlet port, at least part of said air induction cavity being formed within the cylinder block, and at least one inlet opening in said manifold for the entry of air to said induction cavity.

2. A multi-cylinder engine as claimed in claim 1, wherein said common wall of the cylinder block defines a planar face with a first opening therein and an internal cavity within the confines of the cylinder block communicating with said first opening, said internal cavity being closed apart from said first opening and forming part of said induction cavity, and respective second openings in the cylinder block forming or communicating with said air inlet ports.

3. A multi-cylinder engine as claimed in claim 2, wherein said manifold comprises a planar face complementary to the cylinder block planar face and having formed therein complementary first and second openings so that when said respective planar faces are in abutting relation said first and second openings of the cylinder block planar face are in register with said complementary first and second openings of the manifold planar face.

4. A multi-cylinder engine as claimed in claim 1, wherein individual passages are formed in said induction manifold to provide the communication between the induction cavity and the respective inlet ports.

5. A multi-cylinder engine as claimed in claim 4, wherein said passages formed in said manifold communicating each crankcase cavity inlet port with the induction cavity are of a length determined to be tuned to the operation of the engine in a selected speed range.

6. A multi-cylinder engine as claimed in claim 4, wherein a substantial portion of the length of said passages communicating each crankcase cavity inlet port with the induction cavity is formed within the confines of the manifold.

7. A multi-cylinder engine as claimed in claim 6, wherein the level of the manifold intake passage does not extend to a level higher than the level of a cylinder head mounted on the cylinder block.

* * * * *